US010386762B2

(12) United States Patent
Eiki et al.

(10) Patent No.: US 10,386,762 B2
(45) Date of Patent: Aug. 20, 2019

(54) HEATING UNIT INCLUDING HEATING PARTS, IN WHICH EACH HEATING PART INCLUDES HEATING RESISTORS, FIXING DEVICE INCLUDING THIS HEATING UNIT, AND IMAGE FORMING APPARATUS INCLUDING THIS FIXING DEVICE

(71) Applicants: KYOCERA Document Solutions Inc., Osaka (JP); KYOCERA Corporation, Kyoto (JP)

(72) Inventors: Takashi Eiki, Osaka (JP); Hiroki Kawasaki, Osaka (JP); Ryohei Tokunaga, Osaka (JP); Atsushi Kohama, Osaka (JP); Yuhiro Sakai, Osaka (JP); Kotatsu Kawaguchi, Osaka (JP); Hidenobu Nakagawa, Kirishima (JP)

(73) Assignees: KYOCERA Document Solutions Inc., Osaka (JP); KYOCERA Corporation, Kyoto (JP)

( * ) Notice: Subject to any disclaimer, the term of this patent is extended or adjusted under 35 U.S.C. 154(b) by 0 days.

(21) Appl. No.: 16/101,395

(22) Filed: Aug. 11, 2018

(65) Prior Publication Data

US 2019/0056685 A1 Feb. 21, 2019

(30) Foreign Application Priority Data

Aug. 18, 2017 (JP) ..... 2017-157842
Jun. 20, 2018 (JP) ..... 2018-117436

(51) Int. Cl.

*G03G 15/20* (2006.01)
*G03G 15/08* (2006.01)
*G03G 15/16* (2006.01)

(52) U.S. Cl.

CPC ..... *G03G 15/2053* (2013.01); *G03G 15/0865* (2013.01); *G03G 15/16* (2013.01); *G03G 15/2028* (2013.01)

(58) Field of Classification Search

CPC ..... G03G 15/2053; G03G 15/2028
See application file for complete search history.

(56) References Cited

U.S. PATENT DOCUMENTS 2,629,166 A * 2/1953 Marsten ..... H01C 17/23 29/620
4,814,586 A * 3/1989 Grise ..... H05B 3/565 219/549
5,408,574 A * 4/1995 Deevi ..... A24F 47/008 128/202.21

(Continued)

FOREIGN PATENT DOCUMENTS

JP 5241144 B2 7/2013

*Primary Examiner* — G. M. A Hyder
(74) *Attorney, Agent, or Firm* — Studebaker & Brackett PC

(57) ABSTRACT

A heating unit includes a circuit board, heating parts, and electrode parts. The heating parts are arranged in a first direction on a surface of the circuit board. The electrode parts are disposed on the surface of the circuit board, and electrically connected to both sides of the heating parts in a second direction that is orthogonal to the first direction. Each of the heating parts includes a plurality of heating resistors that is arranged in the first direction. Each of the heating resistors has a size ratio of a first length in the second direction to a second length in the first direction is 1 or more and 100 or less.

12 Claims, 8 Drawing Sheets

(56) References Cited

U.S. PATENT DOCUMENTS

| | | | | |
|---|---|---|---|---|
| 7,132,628 | B2 * | 11/2006 | Ptasienski | H05B 3/26 219/543 |
| 9,098,033 | B2 * | 8/2015 | Shimura | G03G 15/2053 |
| 9,098,034 | B2 * | 8/2015 | Shimura | G03G 15/2053 |
| 2007/0237536 | A1 * | 10/2007 | Roof | G03G 15/2042 399/69 |
| 2009/0230114 | A1 * | 9/2009 | Taniguchi | G03G 15/2042 219/216 |
| 2011/0062140 | A1 * | 3/2011 | Sakakibara | H05B 3/0095 219/216 |
| 2012/0121306 | A1 * | 5/2012 | Shimura | H05B 3/0095 399/329 |
| 2012/0201581 | A1 * | 8/2012 | Shimura | G03G 15/2042 399/329 |
| 2014/0076878 | A1 * | 3/2014 | Shimura | G03G 15/2042 219/216 |
| 2018/0004135 | A1 * | 1/2018 | Sako | G03G 15/2007 |

* cited by examiner

HEATING UNIT INCLUDING HEATING PARTS, IN WHICH EACH HEATING PART INCLUDES HEATING RESISTORS, FIXING DEVICE INCLUDING THIS HEATING UNIT, AND IMAGE FORMING APPARATUS INCLUDING THIS FIXING DEVICE

INCORPORATION BY REFERENCE

This application is based on and claims the benefit of priority from Japanese Patent applications No. 2017-157842 filed on Aug. 18, 2017, and No. 2018-117436 filed on Jun. 20, 2018; the entire contents of which are incorporated herein by reference.

BACKGROUND

The present disclosure relates to a heating unit, a fixing device, and an image forming apparatus.

An electrographic image forming apparatus includes a fixing device that thermally fixes toner on a medium.

For example, a heater of the fixing device is proposed. The heater has a circuit board that extends in a direction orthogonal to a conveying direction of a recording material, heating resistors that are formed on the circuit board with a long pattern in a longer side direction of the circuit board, and a first conductive part and a second conductive part that are formed in a longer side direction of the heating resistor on respective both sides of a shorter side direction of the heating resistor. The heating resistors generate heat when an electrical current flows between the first and second conductive parts in the conveying direction of the recording material. The first conductive part has divided conductors that are plurally divided in the longer side direction. In the fixing device, electrical power is independently supplied to each heating resistor that corresponds to a divided conductor so as to restrain temperature rising at a non-sheet passing region through which the recording material does not pass.

SUMMARY

In accordance with an aspect of the present disclosure, a heating unit includes a circuit board, heating parts, and electrode parts. The heating parts are arranged in a first direction on a surface of the circuit board. The electrode parts are disposed on the surface of the circuit board, and electrically connected to both sides of the heating parts in a second direction that is orthogonal to the first direction. Each of the heating parts includes a plurality of heating resistors that is arranged in the first direction. Each of the heating resistors has a size ratio of a first length in the second direction to a second length in the first direction, the size ratio being 1 or more and 100 or less.

In accordance with an aspect of the present disclosure, a fixing device includes a fixing member, a pressing member, and a heating unit. The fixing member heats toner on a medium with rotating around an axis thereof. The pressing member, with rotating around an axis thereof, forms a pressing area with the fixing member and presses the toner on the medium passing through the pressing area. The heating unit is provided corresponding to the pressing area across the fixing member and heats the fixing member. The heating unit includes a circuit board, heating parts, and electrode parts. The heating parts are arranged in an axial direction of the fixing member on a surface of the circuit board. The electrode parts are disposed on the surface of the circuit board, and electrically connected to both sides of the heating parts in a passing direction that is orthogonal to the axial direction. Each of the heating parts includes a plurality of heating resistors that is arranged in the axial direction. Each of the heating resistors has a size ratio of a first length in the passing direction to a second length in the axial direction, the size ratio being 1 or more and 100 or less.

In accordance with an aspect of the present disclosure, an image forming apparatus includes the aforementioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an embodiment of the present disclosure will be explained with reference to attached figures. Arrows "Fr", "Rr", "L", "R", "U", and "D" shown in the figures respectively indicate a front side, a rear side, a left side, a right side, an upside, and a downside.

«Overall Configuration of Printer»

Figure 1:
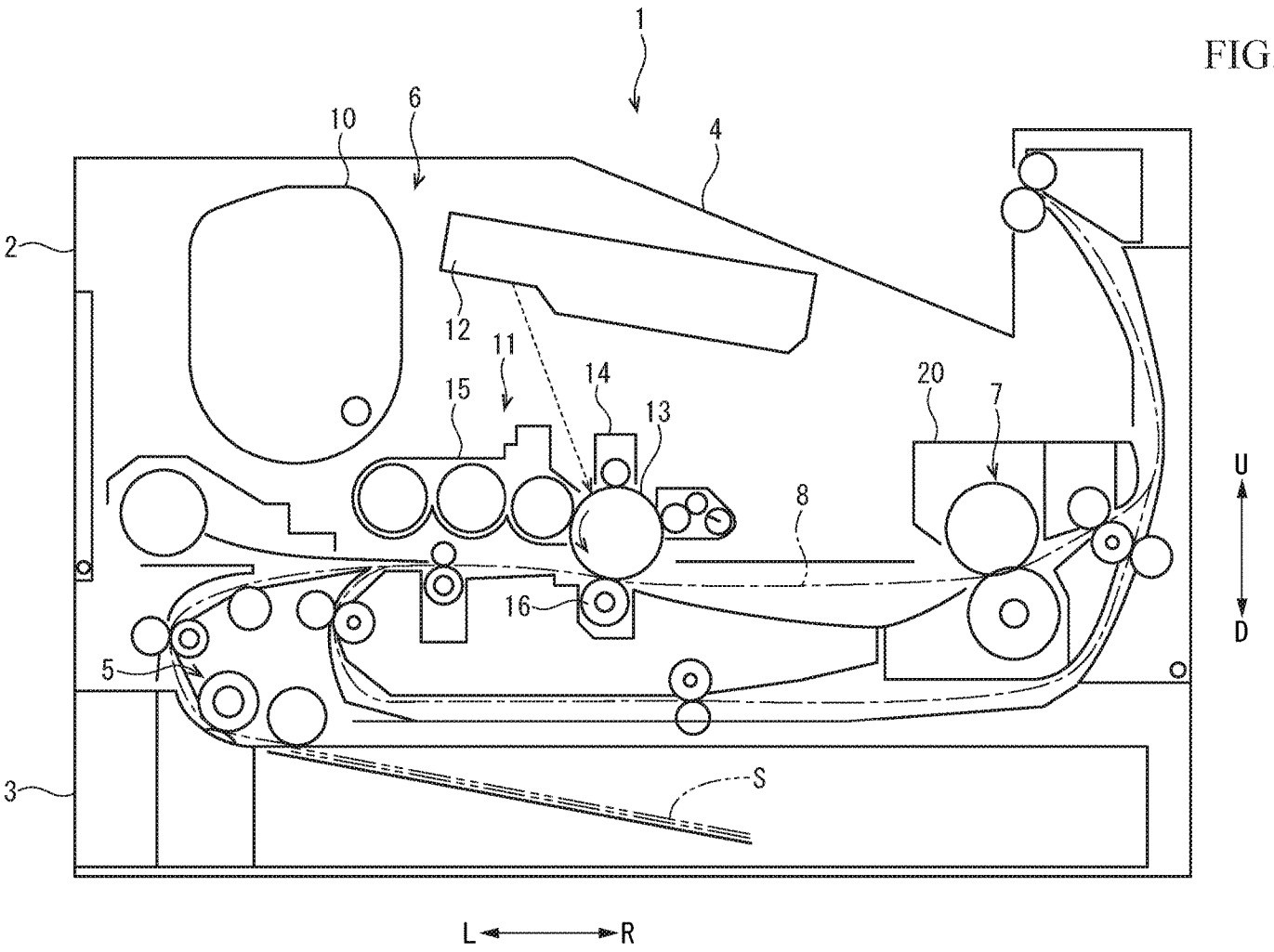
FIG. 1 is a schematic view (front view) that shows a printer in accordance with one embodiment of the present disclosure.

With reference to FIG. 1, a printer 1 as an example of an image forming apparatus will be described. FIG. 1 is a schematic view (front view) that shows the printer 1.

The printer 1 includes main body 2 configuring a substantially rectangular parallelepiped-appearance. In a lower part of the main body 2, a sheet feeding cartridge 3 storing sheets S (media) such as plain papers is provided. In an upper surface of the main body 2, a sheet ejecting tray 4 is provided. The sheet S is not limited to the paper sheet and can be a resin sheet or the like.

The printer 1 includes a sheet feeding device 5, an imaging device 6, and a fixing device 7. The sheet feeding device 5 is provided at an upstream end of a conveying path 8 extending from the sheet feeding cartridge 3 to the sheet ejecting tray 4. The imaging device 6 is provided at an intermediate part of the conveying path 8, and the fixing device 7 is provided at a downstream side of the conveying path 8.

The imaging device 6 includes a toner container 10, a drum unit 11, and an optical scanning device 12. The toner container 10 contains, for example, black toner (developer). The drum unit 11 includes a photosensitive drum 13, a charger 14, a development device 15, and a transfer roller 16. The transfer roller 16 is in contact with a downside of the photosensitive drum 13 so as to form a transferring nip. The toner may be two-component developer obtained by mixing toner and carrier, or may be one-component developer composed of magnetic toner.

A control device (not shown) of the printer 1 appropriately controls so as to execute image forming process as follows. The charger 14 charges a surface of the photosensitive drum 13. The photosensitive drum 13 receives a scanning light emitted from the optical scanning device 12 and carries an electrostatic latent image. The development device 15 develops the electrostatic latent image on the photosensitive drum 13 to form a toner image using the toner supplied from the toner container 10. The sheet S is fed out by the sheet feeding device 5 from the sheet feeding cartridge 3 to the conveying path 8. The toner image having been formed on the photosensitive drum 13 is transferred to the sheet S passing through the transferring nip. The fixing device 7 thermally fixes the toner image on the sheet S. Afterward, the sheet S is ejected to the sheet ejecting tray 4.

«Fixing Device»

Figure 2:
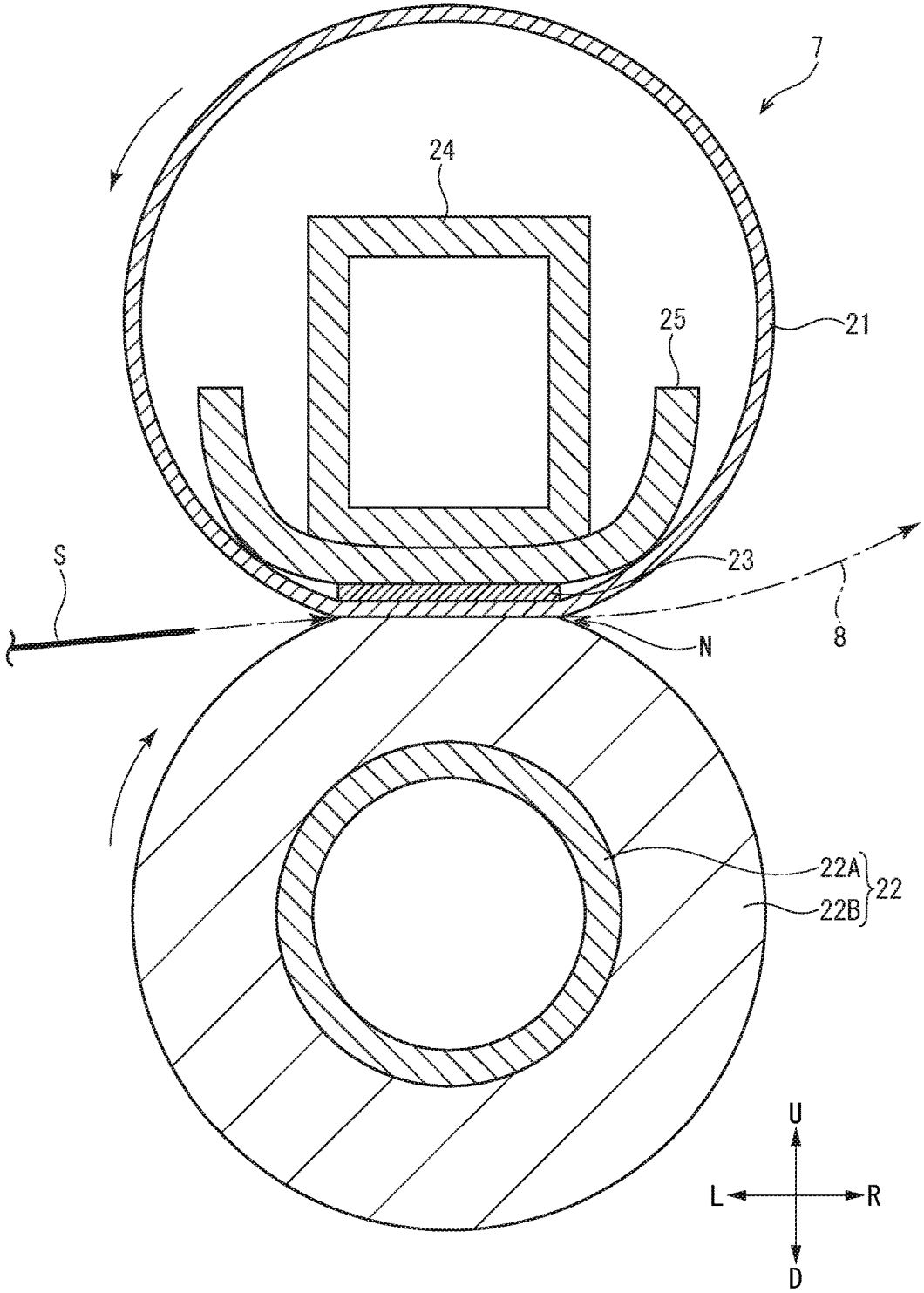
FIG. 2 is a sectional view that schematically shows a fixing device in accordance with one embodiment of the present disclosure.
Figure 3:
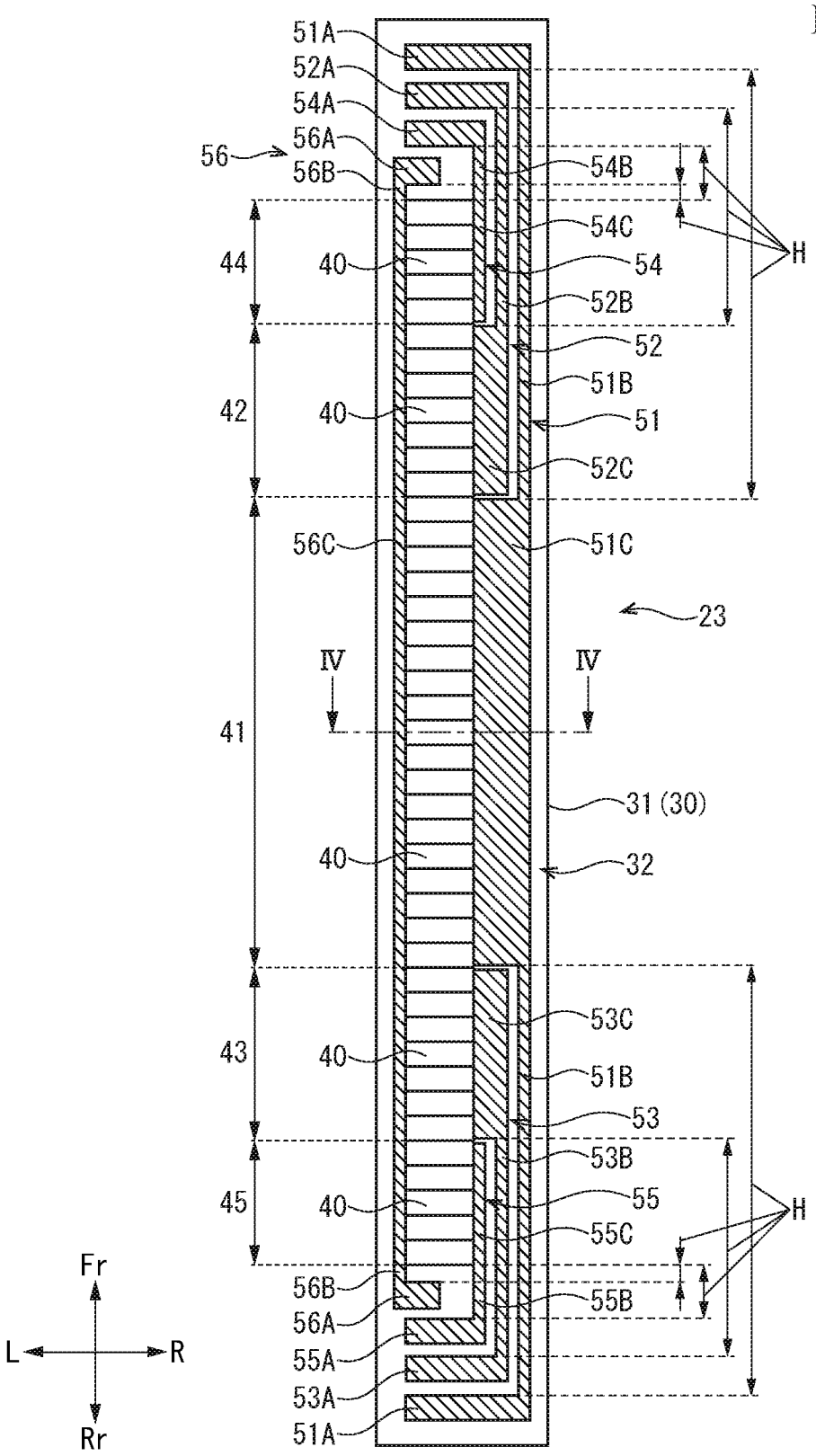
FIG. 3 is a bottom view that schematically shows a heater in accordance with one embodiment of the present disclosure.
Figure 4:
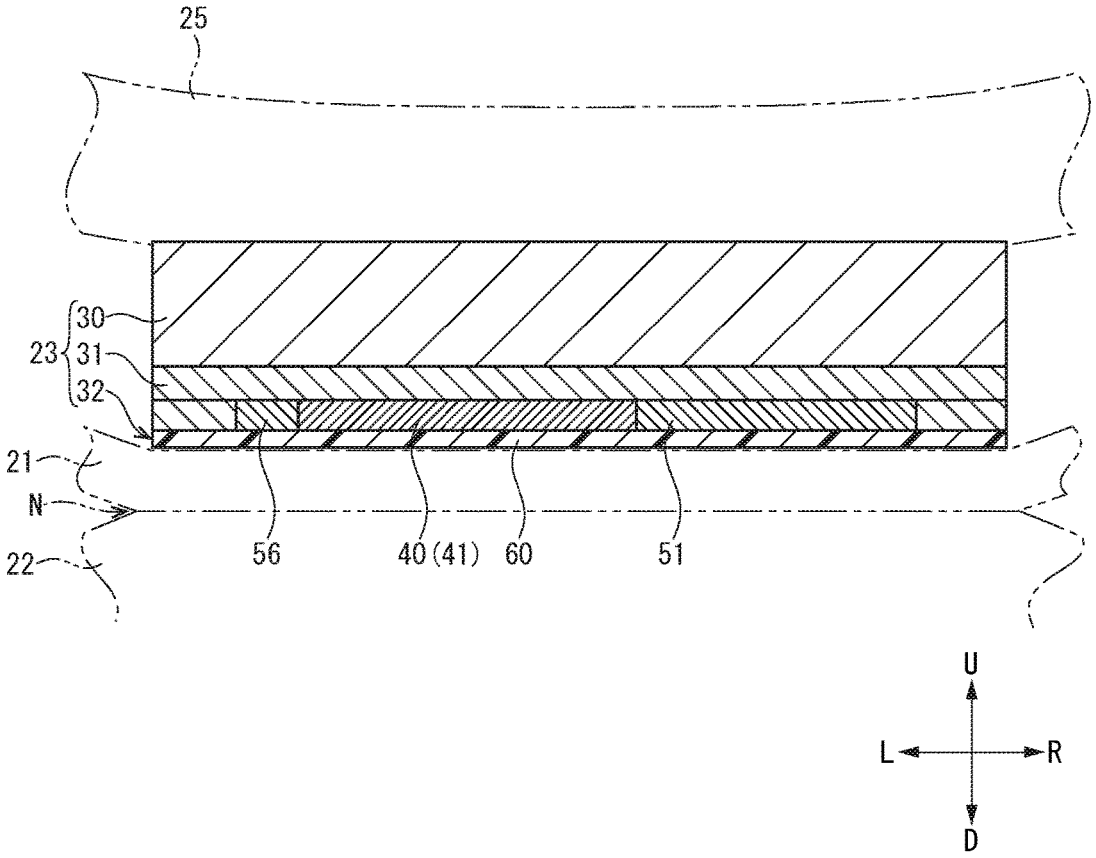
FIG. 4 is a sectional view along a line IV-IV of FIG. 3.
Figure 5:
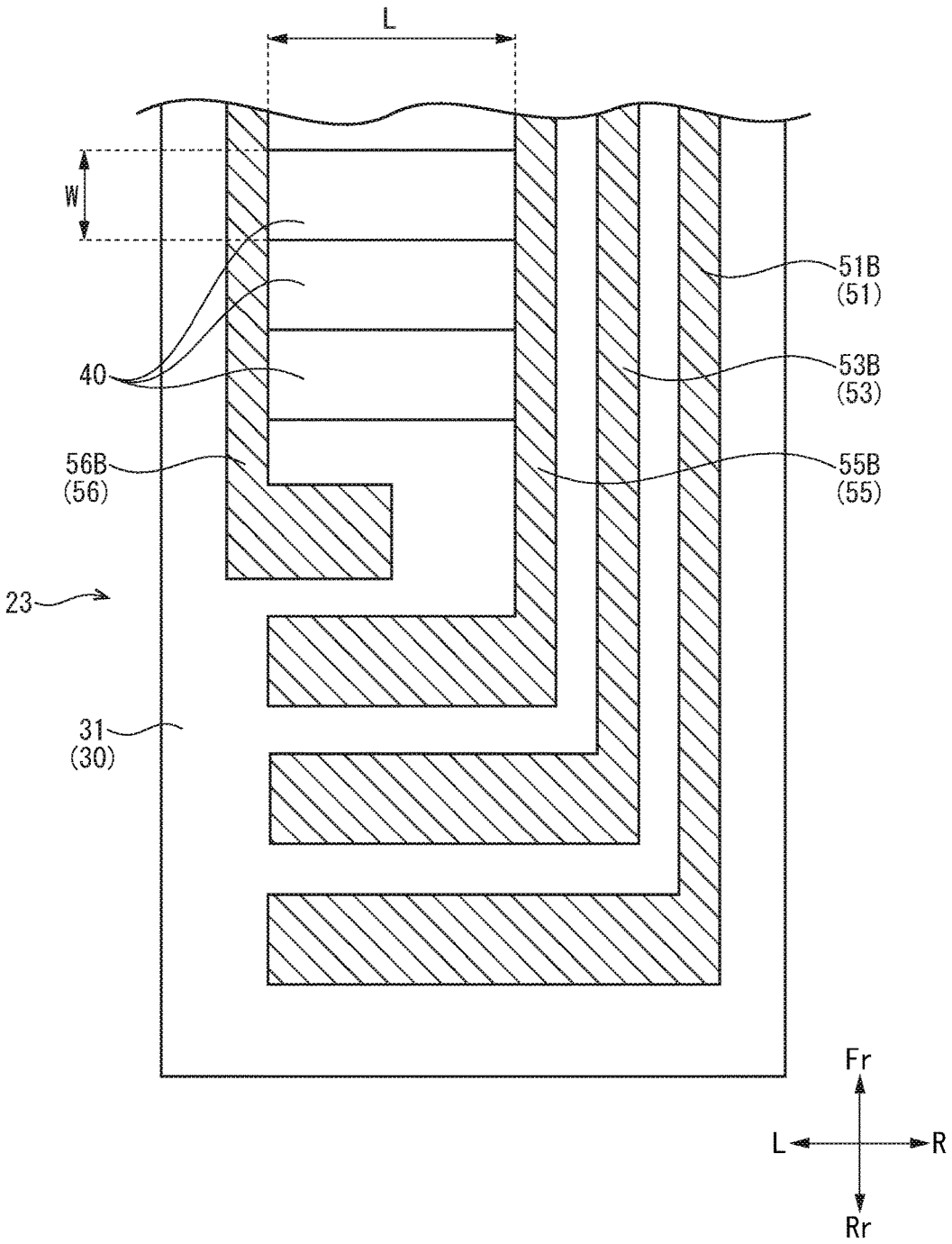
FIG. 5 is a bottom view that schematically shows a part of the heater in accordance with one embodiment of the present disclosure.

Subsequently, the fixing device 7 will be explained with reference to FIGS. 2 to 5. FIG. 2 is a sectional view that schematically shows the fixing device 7. FIG. 3 is a bottom view that schematically shows a heater 23. FIG. 4 is a sectional view along a line IV-IV of FIG. 3. FIG. 5 is a bottom view that schematically shows a part of the heater 23.

As shown in FIG. 2, the fixing device 7 includes a fixing belt 21, a pressing roller 22, and a heater 23. The fixing belt 21 and the pressing roller 22 are provided in a housing 20 (cf. FIG. 1). The heater 23 is a heat source that heats the fixing belt 21.

<Fixing Belt>

The fixing belt 21, which is an example of a fixing member, is an endless belt that is a substantially cylindrical member being elongated in a front-back direction (i.e., an axial direction). For instance, a surface of the fixing belt 21 is made of a synthetic resin material that has heat resistance property and elasticity, such as a polyimide resin. The fixing belt 21 is located in an upper part of the housing 20. A pair of substantially cylindrical caps (not shown) are fitted at both ends in the axial direction of the fixing belt 21. A belt guide (not shown) that retains a substantially cylindrical form of the fixing belt 21 may be provided in the fixing belt 21.

A pressing member 24 is provided in the fixing belt 21. For instance, the pressing member 24 is made of a metallic material and is a substantially rectangular cylindrical member being elongated in the axial direction. The pressing member 24 passes through the fixing belt 21 (and the caps) in the axial direction and is supported by the housing 20. The above-described fixing belt 21 is supported rotatably with respect to the pressing member 24.

<Pressing Roller>

The pressing roller 22, which is an example of a pressing member, is a substantially cylindrical member being elongated in the front-back direction (i.e., the axial direction). The pressing roller 22 is located in a down part of the housing 20. The pressing roller 22 includes a metallic core metal 22A and an elastic layer 22*b*, such as a silicone sponge, that is laminated on an outer peripheral surface of the core metal 22A. Both ends in the axial direction of the core metal 22A are rotatably supported by the housing 20. A driving motor (not shown) is connected to the core metal 22A via a gear train or the like. The pressing roller 22 is rotationally driven by the driving motor. The fixing device 7 includes a pressure adjusting part (not shown) that raises and lowers the pressing roller 22 so as to adjust contact pressure of the pressing roller 22 against the fixing belt 21. Pressing the pressing roller 22 against the fixing belt 21 causes to form a pressing area N between the fixing belt 21 and the pressing roller 22. The pressing area N is a region from a position upstream in a conveying direction of the sheet S in which the pressure is 0 Pa to a position downstream in the conveying direction of the sheet S in which the pressure returns to 0 Pa after passing through a position in which the pressure becomes a maximum.

<Heater>

The heater 23, which is an example of a heating unit, is a substantially rectangular plate shape member being elongated in the front-back direction (i.e., the axial direction). (cf. FIG. 3) The heater 23 is fixed beneath the pressing member 24 via a supporting member 25. For instance, the supporting member 25 is made of a heat resistant resin material and is a substantially half-cylindrical member being elongated in the axial direction. The supporting member 25 is incurvated along a lower inner surface of the fixing belt 21.

As shown in FIGS. 3 and 4, the heater 23 includes a base material 30, a heat insulation layer 31, and a heating and contacting part 32. The base material 30 is fixed on a lower surface of the supporting member 25. The heat insulation layer 31 is formed on a lower surface of the base material 30, which is integrated with the base material 30 so as to form a circuit board. The heating and contacting part 32 is formed on a lower surface of the heat insulation layer 31. In the present specification, a "passing direction (i.e., a second direction)" is a direction that is orthogonal to the axial direction (i.e., a first direction), and is a direction where the sheet S passes (i.e., is conveyed) through the pressing area N of the fixing device 7. Hereinafter, "upstream" and "downstream", and expressions being similar thereto respectively indicate "upstream" and "downstream" in the passing direction, and similar notions.

As shown in FIG. 4, the heater 23 is held beneath the supporting member 25 in which the heating and contacting part 32 is directed to the pressing roller 22 and the heating and contacting part 32 contacts to a inner surface of the fixing belt 21. The heater 23 supports the fixing belt 21 that is pressed by the pressing roller 22, so that the pressing area N is formed at a contacting part of the fixing belt 21 and the pressing roller 22. The heater 23 is provided corresponding to the pressing area N across the fixing belt 21 (see also FIG. 2), and has a function of heating the fixing belt 21. Besides, a temperature sensor (not shown) that detects surface temperature of the fixing belt 21 and/or temperature of the heater 23 is provided in the housing 20.

As shown in FIGS. 3 and 4, for instance, the base material 30 is made of a material that has electrical insulating property, such as a ceramic, and is a substantially rectangular plate shape member being elongated in the axial direction. Both upper and lower surfaces of the base material 30 are formed substantially flat and smooth.

The heat insulation layer 31 is laminated (formed) on one surface (an entire lower surface) of the base material 30. For instance, the heat insulation layer 31 is made of a material that has electrical insulating property and low thermal conductivity, such as a ceramic (a glass), and is formed on the base material. The heat insulation layer 31 has a function of restricting that heat generated at the heating and contacting part 32 is transferred to a side of the base material 30.

The heating and contacting part 32 is laminated on one surface (a lower surface) of the heat insulation layer 31. The heating and contacting part 32 includes plural (e.g., five) heating parts 41 to 45, plural (e.g., six) electrode parts 51 to 56, and a coat layer 60.

For instance, the heating parts 41 to 45 are made of a material (such as a metal) that has electrical conductivity with a resistance value that is higher than that of the electrode parts 51 to 56, and are formed on a lower surface of the heat insulation layer 31. As shown in FIG. 3, the heating parts 41 to 45 are arranged in a line in the axial direction. Each of the heating parts 41 to 45 is formed of heating resistors 40 that are arranged in line in the axial direction. Although details will be described afterward, each of the heating resistors 40 is a substantially rectangular member being elongated in the passing direction. All of the heating resistor 40 are formed in substantially the same dimensions.

The heating part 41 that is located at a center in the axial direction is formed of heating resistors 40 that are arranged in a range corresponding to a front-to-rear width of a small size (e.g., A5 size) sheet S that passes through the pressing area N. The heating parts 42 and 43 that are located on both sides in the axial direction of the heating part 41 are formed of heating resistors 40 that are arranged in a range corresponding to a front-to-rear width of a middle size (e.g., B5 size) sheet S that passes through the pressing area N. The heating parts 44 and 45 that are located on both sides in the axial direction of the heating parts 42 and 43 are formed of heating resistors 40 that are arranged in a range corresponding to a front-to-rear width of a normal size (e.g., A4 size) sheet S that passes through the pressing area N.

The heating resistors 40 are formed in the same size in the axial direction, and in the same size in the passing direction. In the present specification, "the same size" does not mean completely the same size, but means allowing a venial error in production.

For instance, with regard to the heater 23 as shown in FIG. 5, a size (W) of the heating resistor 40 in the axial direction (i.e., the front-back direction) (hereinafter, the size (W) may be stated as a "width (W)" or a "second length") is set to approximately 5 mm, and a size (L) of the heating resistor 40 in the passing direction (i.e., the right-left direction) (hereinafter, the size (L) may be stated as a "length (L)" or a "first length") is set to approximately 20 mm. As just described, the length (L) of the heating resistor 40 is set to be equal to or greater than the width (W) of the heating resistor 40. With respect to this instance of the heating resistor 40, a size ratio (L/W) of the length (L) to the width (W) is set to "4."

For instance, as shown in FIG. 3, the electrode parts 51 to 56 are made of a material (such as a metal) that has electrical conductivity with resistance value that is lower than that of the heating resistors 40, and are disposed on the lower surface of the heat insulation layer 31. The electrode parts 51 to 56 are electrically connected to both sides in the passing direction of the heating parts 41 to 45. In detail, the electrode parts 51 to 56 include a common electrode 56 that is commonly connected to the heating parts 41 to 45 and plural (e.g., five) discrete electrodes 51 to 55 that are respectively connected to the heating parts 41 to 45. The discrete electrode 51 is connected to downstream ends (i.e., right ends) of the heating resistors 40 that form the heating part 41 in the center in the axial direction. In an analogous fashion, the other discrete electrodes 52 to 55 are each connected to downstream ends of the heating resistors 40 that form the respective heating parts 42 to 45. On the other hand, the common electrode 56 is connected to upstream ends (i.e., left ends) of all of the heating resistors 40. With respect to explanations of the present specification that are common to the discrete electrodes 51 to 55 and the common electrode 56, they are merely stated as "electrode parts 51 to 56" therein.

The electrode parts 51 to 56 respectively include electrode terminal parts 51A to 56A that are connected to tip parts of drawing-out parts 51B to 56B that respectively extend from portions connected to the heating parts 41 to 45 (i.e., connecting portions 51C to 56C) to positions outside the heating parts 41 to 45 in the axial direction. The drawing-out parts 51B to 56B are portions that are respectively drawn out from portions connected to the respective heating parts 41 to 45, and are formed between outer ends in the axial direction of the heating parts 41 to 45 and the electrode terminal part 56A. Since the electrode terminal parts 51A to 56A are connecting terminals that electrically connect to an external device such as a power source, the electrode terminal parts 51A to 56A are drawn outside the heating parts 41 to 45 in the axial direction by the drawing-out parts 51B to 56B. In detail, both of the drawing parts 51B of the discrete electrode 51 extend from the connecting portion 51C connected to the heating part 41 toward both outsides in the axial direction. The electrode terminal parts 51A are respectively connected to both ends of the drawing-out parts 51B, and bend toward an upstream side (i.e., a left side). The drawing-out parts 52B, 54B of the discrete electrodes 52, 54 and the drawing-out parts 53B, 55B of the discrete electrode 53, 55 extend outside in the axial direction from the connecting portions 52C to 55C connected to the heating parts 42 to 45. The electrode terminal parts 52A to 55A are connected to respective tip parts of the drawing-out parts 52B to 55B, and bend toward the upstream side. The electrode terminal parts 52A, 53A are located inside in the axial direction of the electrode terminal parts 51A, and the electrode terminal parts 54A, 55A are located inside in the axial direction of the electrode terminal parts 52A, 53A. On the other hand, the drawing-out parts 56B of the common electrode 56 extend outside in the axial direction from the connecting portion 56C connected to the heating parts 41 to 45. The electrode terminal parts 56A are respectively connected to both ends of the drawing-out parts 56B, and bend toward a downstream side (i.e., a right side). The electrode terminal parts 56A are located inside in the axial direction of the electrode terminal parts 54A, 55A.

A length of each drawing-out part 56B of the common electrode 56 is set to be shorter than a length of each drawing-out part 51B to 55B of the discrete electrodes 51 to 55. Here, the lengths of the drawing-out parts 51B to 56B are respective distances H from respective boundaries of portions connected to the respective heating parts 41 to 45 (i.e., the respective connecting portions 51C to 56C) to the respective electrode terminal parts 51A to 56A (cf. FIG. 3). That is, the drawing-out parts 51B to 56B respectively connect the connecting portions 51C to 56C connected to the heating parts 41 to 45 and the electrical terminal parts 51A to 56A. In FIGS. 3 to 5, the lengths of the drawing-out parts 51B to 55B mean lengths in the axial direction of the drawing-out parts 51B to 55B. A length (a width) in the axial direction of each electrode terminal part 56A of the common electrode 56 is set to be longer than a length (a width) in the axial direction of each electrode terminal part 51A to 55A of the discrete electrodes 51 to 55.

As shown in FIG. 4, the coat layer 60 coats the heating parts 41 to 45 and the electrode parts 51 to 56 except for the electrode terminal parts 51A to 56A. For instance, the coat layer 60 is made of a material that has electrical insulating property and relatively small sliding friction force against the fixing belt 21, such as a ceramic. The coat layer 60 forms a surface that contacts to the inner surface of the fixing belt 21. Materials that have electrical insulating property such as the heat insulation layer 31 and the coat layer 60 are laminated on portions on which the heating parts 41 to 45 or the electrode parts 51 to 56 are laminated.

In order to manufacture the above-described heater 23, for instance, a film forming technology such as sputtering, a production technology of a printed-circuit board, or a screen printing technology, or any combination of these technologies can be used. For example, the heat insulation layer 31 and the heating and contacting part 32 (the heating parts 41 to 45, the electrode parts 51 to 56, the coat layer 60) may be laminated on the base material 30 using the sputtering technology. Alternatively, the heat insulation layer 31 and the heating and contacting part 32 may be formed on the base material 30 by repeating processes of exposure, development, etching, delamination, lamination and so forth, using photolithographic masks used as the production technology of the printed-circuit board. The heat insulation layer 31 and the heating and contacting part 32 may be formed by applying (i.e., screen-printing) electrical insulation paint or electrically conductive paint to the base material 30. By using these manufacturing processes, the heat insulation layer 31, the heating parts 41 to 45, and the electrode parts 51 to 56 can be formed accurately.

The electrode parts 51 to 56, the driving motor and so forth of the heater 23 are electrically connected via various driving circuits (not shown) to a power source (not shown). The heater 23 (the electrode parts 51 to 56), the driving motor, the temperature sensor and so forth are electrically connected via various circuits to a control device of the printer 1. The control device controls devices or the like being connected thereto.

«Operation of the Fixing Device»

Hereinafter, operation of the fixing device 7 (i.e., fixing processing) will be explained mainly referring to FIG. 2.

The control device executes driving control of the driving motor and the heater 23. The pressing roller 22 is rotated by driving force of the driving motor, and the fixing belt 21 is rotated by following the pressing roller 22 (cf. solid lines in FIG. 2). The heating resistors 40 are heated by applying electrical current in the passing direction between the electrode parts 51 to 56 sandwiching the heating parts 41 to 45. As a result, the pressing area N of the fixing belt 21 is heated.

In the above heating process, the control device changes the heating parts 41 to 45 (cf. FIG. 3) to be heated in accordance with a size of the sheet S. For instance, when a normal size of the sheet S passes through the pressing area N, the control device supplies all of the heating parts 41 to 45 with electrical power so as to heat all of the heating parts 41 to 45. Or, for instance, the control device heats the heating parts 41 to 43 when a middle size of the sheet S passes through the pressing area N, and heats the heating part 41 when a small size of the sheet S passes through the pressing area N. Thereby, a necessary portion of the fixing belt 21 (or the pressing area N) can be heated in accordance with the size of the sheet S. As a result, excessive temperature rise of both ends in the axial direction of the fixing belt 21 can be restrained.

The temperature sensor detects surface temperature of the fixing belt 21 and transmits a detection signal via an input circuit to the control device. When receiving a detection signal indicating that a preset temperature (e.g., 150 to 200 degrees Celsius) is attained from the temperature sensor, the control device starts to execute the above-explained image forming process with controlling the heater 23 so as to maintain the preset temperature. The sheet S on which the toner image is transferred enters the housing 20, then the fixing belt 21 heats the toner (i.e., the toner image) on the sheet S that passes through the pressing area N with normally rotating around the axis. The pressing roller 22 presses the toner on the sheet S that passes through the pressing area N with rotating around the axis. As a result, the toner image is fixed on the sheet S. Then the sheet S on which the toner image is fixed is sent out of the housing 20 to be ejected to the sheet ejecting tray 4.

With respect to the heating resistor 40 being a thin film, density and other characteristics thereof tends to be disproportional, and thus unevenness in electrical resistance is liable to occur. In a supposing case in which the heating resistor 40 is elongated in the axial direction, the unevenness of the electrical resistance occurs along the axial direction, and thus electrical current flows in a direction in which the electrical current is easy to flow. For this reason, there is a case in which the heating resistor 40 is not heated uniformly. To address this problem, in the fixing device 7 (the heater 23) in accordance with the present embodiment, the length (L) of the heating resistor 40 is set to be equal to or greater than the width (W) of the heating resistor 40, which causes heating efficiency (η) of the heating resistor 40 to be improved.

Here, the heating efficiency can be calculated by formula (1) below.

$$\eta=((C\times T)+G)/(P\times t)\times 100 \qquad \text{Formula (1)}$$

where

C: thermal capacity of the heating resistor [J/K]

T: temperature that rises in one second [K]

G: heat discharge [J]

P: supply power [W]

t: power supply time [s]

For instance, following results were obtained through experiments in which the width (W) of the heating resistor 40 was fixed to 3 mm while changing the length (L) of the heating resistor 40 into 3 mm, 4 mm, or 5 mm (the size ratio (L/W)=1.67) and then the heating efficiency (η) was measured:

(Case 1) the length of the heating resistor 40 (L)=3 mm, the size ratio (L/W)=1.00, the heating efficiency (η)=94%.

(Case 2) the length of the heating resistor 40 (L)=4 mm, the size ratio (L/W)=1.33, the heating efficiency (η)=97%.

(Case 3) the length of the heating resistor 40 (L)=5 mm, the size ratio (L/W)=1.67, the heating efficiency (η)=99%.

As described above, a tendency that the heating efficiency (η) increased with increasing the size ratio (L/W) of the heating resistor 40 was observed.

With respect to the fixing device 7 (in particular, the heater 23) in accordance with the present embodiment, the length (L) of the heating resistors 40 is set to 20 mm and the width (W) of the heating resistors 40 is set to 5 mm. Notwithstanding, these exemplification in the present disclosure have no limitative meanings. The length (L) of the heating resistors 40 may be set in a range of 3 mm or more and 20 mm or less, on grounds of manufacturing easiness, a maximum length of the pressing area N, and so forth. The width (W) of the heating resistors 40 may be set in a range of 0.2 mm or more and 5 mm or less, on grounds of manufacturing easiness, a maximum length of the pressing area N, and so forth. Each of the heating resistors 40 may be set so that (i.e., may have) the size ratio (L/W) of the size (L) in the passing direction to the size (W) in the axial direction is set to 1 or more and 100 or less.

With respect to the above-explained fixing device 7 (in particular, the heater 23) in accordance with the present embodiment, the size (L) in the passing direction of the heating resistor 40 is set to be equal to or more than the size (W) in the axial direction thereof. According to this constitution, an elongation of the width (W) of the heating resistor 40 is restrained, which can reduce a risk of distributing the unevenness of the electrical resistance in the axial direction of the heating resistor 40. Thereby the electrical current can be fed uniformly to the whole heating resistor 40, so that the heating resistor 40 can be heated uniformly. Therefore, the heating efficiency (η) can be improved. In the present specification, "uniformly" does not mean complete uniformity (evenness), but means allowing a venial error. For instance, an error of a few degrees in a heating temperature may be allowed.

With respect to the fixing device 7, all of the heating resistors 40 have the same length (L) and the same width (W), which can cause the resistance values of the heating resistors 40 to be constant. Therefore, the heating efficiencies (η) of the heating resistors 40 can be set to be constant. In the present specification, "constant" does not mean complete unchangeability, but means allowing a venial error. For instance, an error of a few percent in the heating efficiency (η) may be allowed.

With respect to the fixing device 7 (in particular, the heater 23) in accordance with the present embodiment, the lengths of the drawing-out parts 56B of the common electrode 56 are set to be shorter than the lengths of the drawing-out parts 51B to 55B. As a result, an electrical resistance of the common electrode 56 can be reduced, which can restrain electrical power attenuation therein.

The electrode terminal parts 51A to 56A are located on both sides outside the heating parts 41 to 45 in the axial direction. Based on requirements of downsizing the heater 23 and so forth, the electrode terminal parts 51A to 56A are located within a limited range in the base material 30, which causes the electrode terminal parts 51A to 56A to be narrow. On the other hand, since a large electrical current flows in the common electrode 56, it is preferable that power attenuation by electrical resistance be restrained. On that regard, the widths of the electrode terminal parts 56A of the common electrode 56 are set to be wider than the widths of the other electrode terminal parts 51A to 55A in the fixing device 7 (in particular, the heater 23) in accordance with the present embodiment, which can decrease the electrical resistance of the common electrode 56. Thereby the power attenuation therein can be effectively restrained. Nonetheless, depending on magnitude of the electrical current that flows in the common electrode 56, the widths of the electrode terminal parts 56A of the common electrode 56 may be set to the same widths of the other electrode terminal parts 51A to 55A.

«First Variation»

Figure 6:
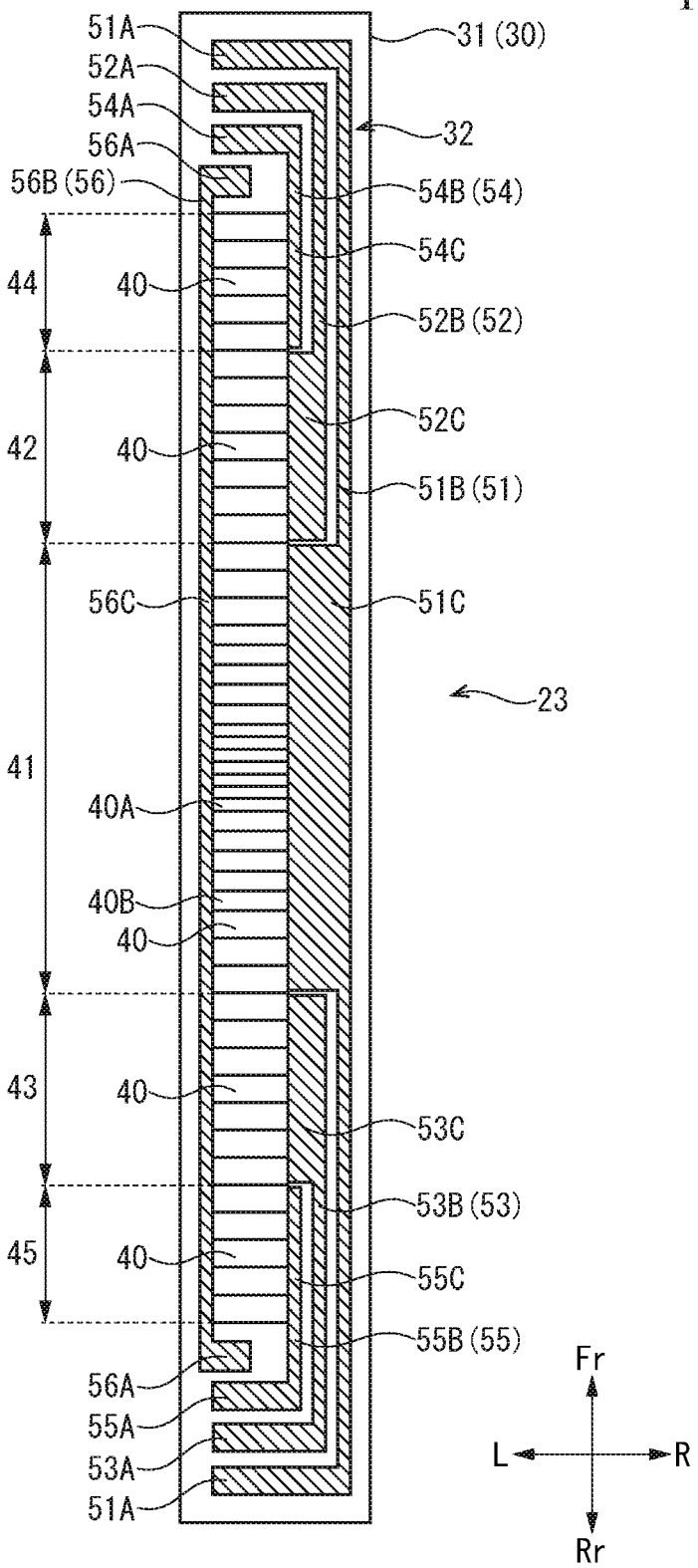
FIG. 6 is a bottom view that schematically shows a heater in accordance with a first variation of one embodiment of the present disclosure.

With respect to circuitry (including the heating resistors 40, the electrode parts 51 to 56, and so forth) that forms the above-described heater 23, effects of a voltage drop increase with increasing distance from the electrode terminal parts 51A to 56A. For this reason, it is preferable to adjust resistance values of the heating resistors 40 that are distant from the electrode terminal parts 51A to 56A. For this reason, with respect to the fixing device 7 (in particular, the heater 23) in accordance with a first variation of the present embodiment, the size ratios (L/W) of the heating resistors 40 are set so as to increase stepwisely (i.e., discretely) with increasing distance from the electrode terminal parts 51A to 56A as shown in FIG. 6. In other words, while all of the heating resistors 40 are formed having the same length (L), heating resistors 40 that constitute a part of the heating part 41 (hereinafter, these heating resistors 40 are stated using reference characters 40A, 40B in order to discriminate from the other heating resistors 40) are formed shorter in the axial direction (i.e., narrower) than the other heating resistors 40. Heating resistors 40A that are located near the center in the axial direction of the heating part 41 are formed shorter in the axial direction (i.e., narrower) than heating resistors 40B that are located on both sides outside the heating resistors 40A in the axial direction. That is, the heating resistors 40, the heating resistors 40A, and the heating resistors 40B have the same length (L) and mutually different widths (W). According to this constitution, the sizes (W) in the axial direction of the heating resistors 40A, 40B that are distant from the electrode terminal parts 51A to 56A are relatively narrowed down, which facilitates adjusting the resistance values of the heating resistors 40A, 40B. In the above-described non-limiting example, the size ratios (L/W) of the heating resistors 40 are set so as to increase stepwisely (i.e., discretely). Alternatively, the size ratios (L/W) of the heating resistors 40 may be set so as to increase gradually (i.e., continuously) with increasing distance from the electrode terminal parts 51A to 56A (not shown).

«Second Variation»

Figure 7:
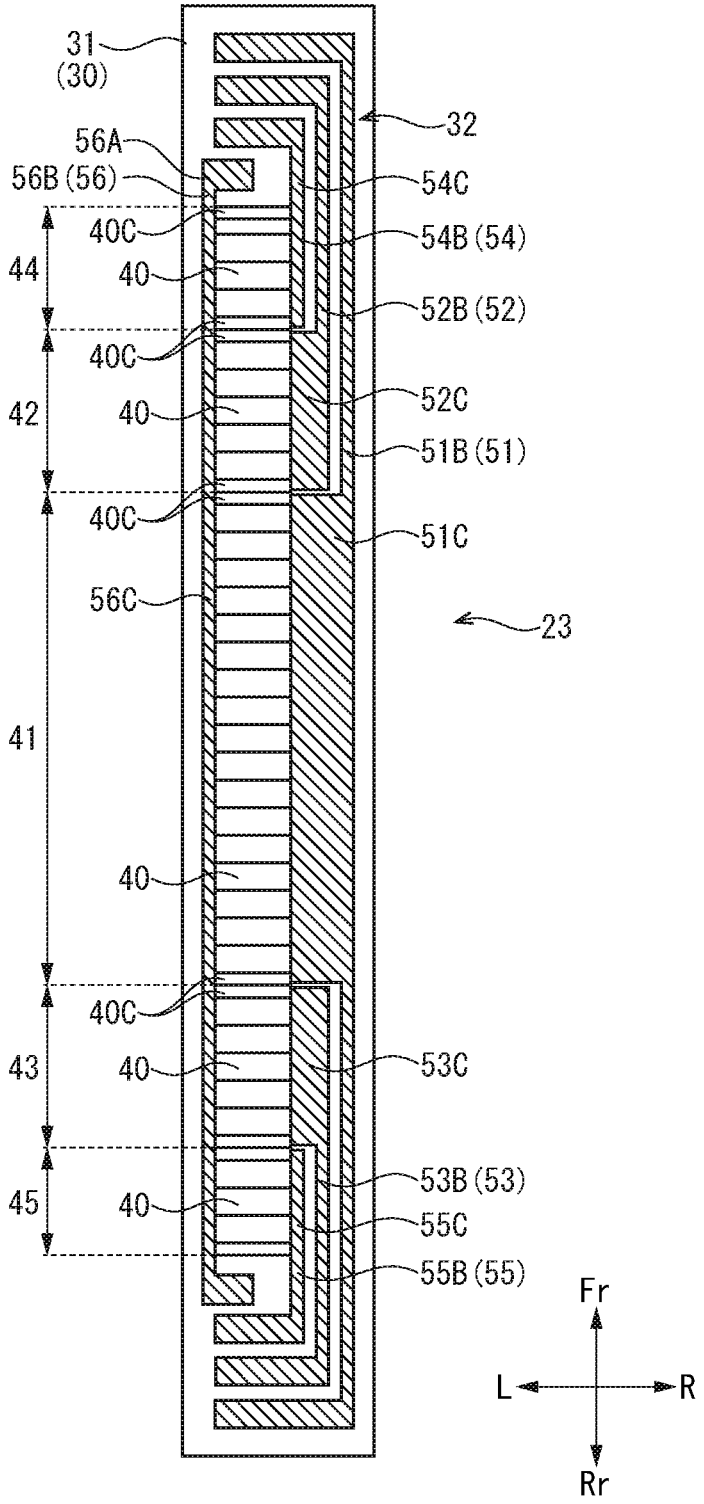
FIG. 7 is a bottom view that schematically shows a heater in accordance with a second variation of one embodiment of the present disclosure.

As shown in FIG. 7, the fixing device 7 (in particular, the heater 23) in accordance with a second variation of the present embodiment, size ratios (L/W) of heating resistors 40 that correspond to ends in the axial direction of the sheet S that passes through the pressing area N (hereinafter, these heating resistors 40 are stated using a reference character 40C in order to discriminate from the other heating resistors 40) are set to be greater than those of the other heating resistors 40. That is, two heating resistors 40C that form both ends in the axial direction of each of the heating parts 41 to 45 are formed to be shorter in the axial direction (i.e., narrower) than the other heating resistors 40. According to this constitution, the heating resistors 40C that are narrow in the axial direction correspond to ends in width direction of each standard size of the sheet S, which facilitates arranging the heating resistors 40 (40C) in accordance with the widths of the sheets S. Thereby the sizes in the axial direction of the heating parts 41 to 45 are accurately fitted to the widths of the sheets S, which can restrain overheating or insufficient heating at the ends in the width direction of sheets S.

With respect to the fixing device 7 in accordance with the first and the second variations of the present embodiment, the length (L) of the heating resistor 40 is fixed and the width (W) thereof is changed so as to change the size ratio (L/W) of the heating resistor 40. Nevertheless, the present disclosure is not limited to this constitution. Alternatively, the width (W) of the heating resistor 40 may be fixed and the length (L) thereof may be changed so as to change the size ratio (L/W) of the heating resistor 40, if a length of the passing direction of the pressing area N is not greatly changed.

According to the heater 23 in accordance with the present embodiment (that includes the first and the second variations, and the same applies hereinafter.), since the electrode parts 51 to 56 are drawn out toward both outsides in the axial direction from the portions connected to the heating parts 41 to 45 (i.e., the connecting portions 51C to 56C), the electrode parts 51 to 56 can be formed shorter, and thus electrical resistance of each of the electrode parts 51 to 56 can be reduced.

«Third Variation»

Figure 8:
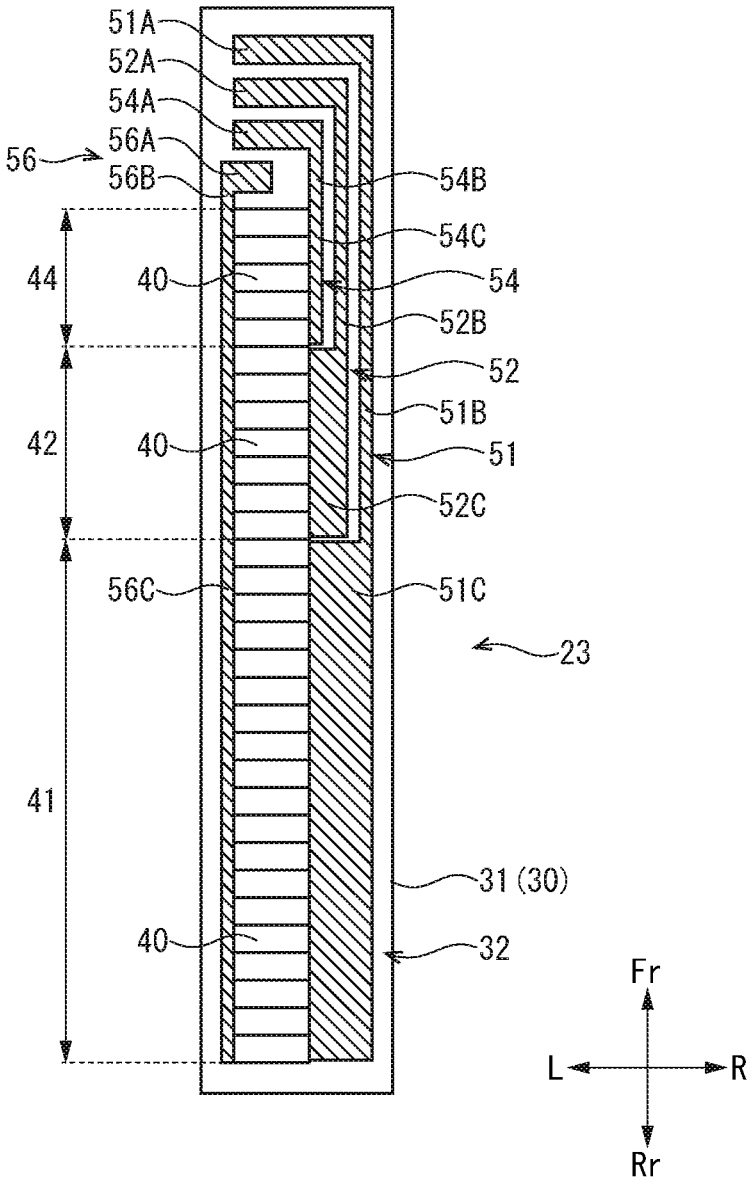
FIG. 8 is a bottom view that schematically shows a heater in accordance with a third variation of one embodiment of the present disclosure.

In a case in which the heater 23 shall be downsized, as shown in FIG. 8, the electrode parts 51, 52, 54, 56 may be drawn out toward one side in the axial direction from the connecting portions 51C, 52C, 54C, 56C connected to the heating parts 41, 42, 44. That is, the electrode terminal parts 51A, 52A, 54A, 56A of the electrode parts 51, 52, 54, 56 may be provided in the one side. According to this constitution, connection between the electrode terminal parts 51A, 52A, 54A, 56A and external devices such as the power source can be integrated in one place, and thus the heater 23 can be downsized. In this case, the heating parts 41, 42, 44 may correspond to three sizes of the sheet S. That is, when a normal size of the sheet S passes through the pressing area N (cf. FIG. 2), the control device supplies all of the heating parts 41, 42, 44 with electrical power so as to heat all of the heating parts 41, 42, 44. Or, for instance, the control device heats the heating parts 41, 42 when a middle size of the sheet S passes through the pressing area N, and heats the heating part 41 when a small size of the sheet S passes through the pressing area N. In this case, it is preferable that the electrode terminal part 56A of the common electrode 56 be located near the heating resistors 40 in consideration of increase of the electrical resistance.

With respect to the fixing device 7 in accordance with the present embodiment, the heating parts 41 to 45 correspond to three sizes of the sheet S. Nevertheless, the present disclosure is not limited to this constitution. It is preferable that the heating parts (the heating resistors 40) be formed so as to correspond at least two sizes of the sheet S. With respect to the fixing device 7 in accordance with the present embodiment, it is constituted that the sheet S passes through the center in the axial direction of the pressing area N. Alternatively, it may be constituted that the sheet S may pass through a position close to one side in the axial direction of the pressing area N. With respect to the fixing device 7 in accordance with the present embodiment, it is exemplified that the drawing-out parts 51B to 56B are elongated in the axial direction. Nevertheless, the present disclosure is not limited to this constitution. For instance, at least one of the drawing-out parts 51B to 56B may have a portion elongated toward the upstream side (i.e., the left side) or the downstream side (i.e., the right side). lengths of the drawing-out parts 51B to 56B in this case respectively mean lengths of portions of electrode parts 51 to 56 that respectively connect the connecting portions 51C to 56C and the electrode terminal parts 51A to 56A.

With respect to the fixing device 7 in accordance with the present embodiment, the pressing roller 22 is rotatively driven and the fixing belt 21 is rotated by following the pressing roller 22 (i.e., gives a driven rotation). Alternatively, the fixing belt 21 may be rotatively driven and the pressing roller 22 may be rotated by following the fixing belt 21 (i.e., may give a driven rotation).

With respect to the fixing device 7 in accordance with the present embodiment, the pressing roller 22 is raised and lowered against (moved to a direction to approach or a direction to separate from) the fixing belt 21. Nevertheless, the present disclosure is not limited to this constitution. Alternatively, the fixing belt 21 may be moved to a direction to approach or a direction to separate from the pressing roller 22.

In the above description regarding the present embodiment, it is exemplified that the disclosure is applied to the monochrome printer 1. Alternatively, for instance, the disclosure may be applied to a color printer, a copying machine, a facsimile, or multifunction peripheral and so forth.

Note that the above description regarding the present embodiment merely shows one aspect in the heating unit, the fixing device, and image forming apparatus in accordance with the present disclosure. The scope of the present disclosure is not limited to the above-described embodiments.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A heating unit comprising:

a circuit board;

heating parts arranged in a first direction on a surface of the circuit board; and electrode parts disposed on the surface of the circuit board, and electrically connected to both sides of the heating parts in a second direction that is orthogonal to the first direction, wherein each of the heating parts comprises a plurality of heating resistors that is arranged in the first direction, and wherein each of the heating resistors has a size ratio of a first length in the second direction to a second length in the first direction, the size ratio being 1 or more and 100 or less, each of the heating resistors has an opposite side extending in the second direction, the opposite side being extended along the second direction.

2. The heating unit according to claim 1, wherein the heating resistors are a same size in the second direction.

3. The heating unit according to claim 1, wherein the electrode parts include a common electrode that is commonly connected to the heating parts and discrete electrodes that are respectively connected to the heating parts, wherein the common electrode and the discrete electrodes respectively include drawing-out parts that respectively extend from portions connected to the heating parts to positions outside the heating parts in the first direction, and wherein a length of each drawing-part of the common electrode is set to be shorter than a length of each drawing-out part of the discrete electrodes.

4. The heating unit according to claim 3, wherein the common electrode and the discrete electrodes respectively include electrode terminal parts at tip parts of the drawing-out parts, and wherein a length in the first direction of each electrode terminal part of the common electrode is set to be longer than a length in the first direction of each electrode terminal part of the discrete electrodes.

5. A fixing device comprising:

a fixing member configured to heat toner on a medium with rotating around an axis thereof;

a pressing member configured to, with rotating around an axis thereof, form a pressing area with the fixing member and press the toner on the medium passing through the pressing area; and a heating unit configured to be provided corresponding to the pressing area across the fixing member and heat the fixing member, wherein the heating unit includes a circuit board;

heating parts arranged in an axial direction of the fixing member on a surface of the circuit board; and electrode parts disposed on the surface of the circuit board, and electrically connected to both sides of the heating parts in a passing direction that is orthogonal to the axial direction, wherein each of the heating parts comprises a plurality of heating resistors that is arranged in the axial direction, and wherein each of the heating resistors has a size ratio of a first length in the passing direction to a second length in the axial direction, the size ratio being 1 or more and 100 or less, each of the heating resistors has an opposite side extending in the passing direction, the opposite side being extended along the passing direction.

6. The fixing device according to claim 5, wherein the heating resistors are a same size in the passing direction.

7. The fixing device according to claim 5, wherein the electrode parts include a common electrode that is commonly connected to the heating parts and discrete electrodes that are respectively connected to the heating parts, wherein the common electrode and the discrete electrodes respectively include drawing-out parts that respectively extend from portions connected to the heating parts to positions outside the heating parts in the axial direction, and wherein a length of each drawing-part of the common electrode is set to be shorter than a length of each drawing-out part of the discrete electrodes.

8. The fixing device according to claim 7, wherein the common electrode and the discrete electrodes respectively include electrode terminal parts at tip parts of the drawing-out parts, and wherein a length in the axial direction of each electrode terminal part of the common electrode is set to be longer than a length in the axial direction of each electrode terminal part of the discrete electrodes.

9. The fixing device according to claim 5, wherein the electrode parts respectively include electrode terminal parts at tip parts that respectively extend from portions connected to the heating parts to positions outside the heating parts in the axial direction, and wherein size ratios of the heating resistors are set so as to increase gradually or stepwisely with increasing distance from the electrode terminal parts.

10. The fixing device according to claim 5, wherein size ratios of heating resistors that correspond to ends in the axial direction of the medium passing through the pressing area are set to be greater than size ratios of the other heating resistors.

11. An image forming apparatus comprising the fixing device according to claim 5.

12. A heating unit comprising:

a circuit board;

heating parts arranged in a first direction on a surface of the circuit board; and electrode parts disposed on the surface of the circuit board, and electrically connected to both sides of the heating parts in a second direction that is orthogonal to the first direction, wherein each of the heating parts comprises a plurality of heating resistors that is arranged in the first direction, each of the heating resistors has a size ratio of a first length in the second direction to a second length in the first direction, the size ratio being 1 or more and 100 or less, and a length in the second direction of a connecting portion connected to the heating resistor of the heating part positioned at a center in the first direction is longer than a length in the second direction of a connecting portion connected to the heating resistor of the heating part positioned at an end in the first direction.

* * * * *